United States Patent [19]

Soshi et al.

[11] Patent Number: 4,892,750

[45] Date of Patent: Jan. 9, 1990

[54] ELECTROSTATIC SPRAY COATING METHOD

[75] Inventors: Fujio Soshi; Tatsuro Hamu, both of Tokyo, Japan

[73] Assignee: Taikisha Ltd., Tokyo, Japan

[21] Appl. No.: 242,355

[22] Filed: Sep. 9, 1988

[30] Foreign Application Priority Data

Sep. 12, 1987 [JP] Japan ..... 62-229361

[51] Int. Cl.[4] ..... B05D 1/04

[52] U.S. Cl. ..... 427/27; 427/33

[58] Field of Search ..... 118/635; 427/33, 27; 361/225, 227, 228

[56] References Cited

U.S. PATENT DOCUMENTS 3,937,180 2/1976 Wiggins ..... 118/635

FOREIGN PATENT DOCUMENTS 55-111856 8/1980 Japan .

*Primary Examiner*—Evan Lawrence

*Attorney, Agent, or Firm*—Webb, Burden, Ziesenheim & Webb

[57] ABSTRACT

An electrostatic spray coating method where an electrical field is generated between a spray gun and an object for electrostatically attracting the paint to the object for coating the same. A positive or negative voltage is preliminarily applied to the object through a clamping device disposed on a floor face of a spray booth with the spraying system for spraying the paint from the spray gun being electrically grounded while the object is maintained electrically insulated by suspending it from a hanger rod with an insulator of a hanger conveyor type installed in the spray booth.

3 Claims, 4 Drawing Sheets

ELECTROSTATIC SPRAY COATING METHOD

BACKGROUND OF THE INVENTION (1) Field Of The Invention

The present invention relates to a method of coating an object by electrostatically attracting a paint material from a spray gun thereto.

(2) Description Of The Prior Art

A typical installation employed in a conventional electrostatic spray coating method of the above-noted type is shown in FIG. 5. In this installation, an electrode 14*a* attached to a spraying opening of a spray gun 14 is preliminarily impressed with a positive or negative high voltage by means of a high-voltage generator 21, such that the paint material as being sprayed from the spray gun 14 is charged and this carged material is attracted to an electrically grounded object 4 for coating the same.

In the above method; however, if the employed paint material is electrically conductive, for example, a metallic paint containing metal powder or a water-thinnable paint containing water as its major solvent which paint has been drawing attention as an environmentally non-polutant material in recent years, since the paint material is continuously fed from a tank 13 to the spray gun 14, there is possibility of short circuit from the electrode 14*a* via the paint material throughout the feed pipe and also at the tank 13. For this reason, the entire paint feed system extending from the tank 13 to the pray gun 14 needs to be insulated by grounding the same, thereby disadvantageously enlarging the insulator equipment.

Moreover, it is a common practice in the spray coating installation to connect the single spray gun 14 via a color selector valve 16 with more than ten tanks 13 containing paint material of different colors. In this case, the above problem is more conspicuous since insulation is necessary for all of the great number of feed units.

With regard to the above problem, the prior art has suggested one solution shown in FIG. 6. In this system, there is provided a relay tank 22 for receiving dripping of paint fed from the upstream system, and the received paint material which has been insulated in the course of dripping thereof is subsequently fed through the downstream system to the spray gun 14. This system has the advantage that the insulated portion may be limited to the downstream side system after the relay tank 22.

On the other hand, with the above system, problems remain that the insulator system needs to additionally include the relay tank and that a plurality of the same are needed if the spray gun is connected to many paint tanks. More particularly, for changing paint colors, in order to obtain good painting efficiency, the paint feed pipe downstream of the valve and the spray gun should be cleaned as quickly as possible for receiving the next color paint and thus it is desired for the color selector valve to be disposed as close as possible to the spray gun, which results in the requirement that a plurality of relay tanks must be independently disposed upstream of the color selector valve for receiving the respective colors of paint materials. This is extremely disadvantageous for the reduction of the insulator system.

Therefore, the primary object of the present invention is to provide an improved electrostatic coating method in which significant reduction of insulator system is enabled by renovating the method of forming the electric field for electrostatically attracting the sprayed paint material to an object to be painted.

SUMMARY OF THE INVENTION

In order to accomplish the above object, in the electrostatic spray coating art where an electrical field is generated between a spray gun and the object for electrostatically attracting the paint to the object for coating the same, a method of the present invention is characterized in that a positive or negative voltage is preliminary applied to the object, with a spraying system for spraying the paint from the spray gun being electrically grounded while the object is maintained electrically insulated.

Functions and effects of the above method will be described next.

The paint material in the form of particles sprayed from the spray gun is charged through the electric field generated between the grounded spray gun and the high-voltage-impressed object and the paint particles are efficiently attracted to the charged object thereby coating the same.

That is to say, in the method of the present invention, since the electric field for attracting the paint particles is generated with the spraying system including the spray gun being grounded, there is no possibility at all of short circuit of the positive or negative high-voltage current at the paint-feed system side via the electroconductive paint. Accordingly, in this method, only the object needs to be maintained electrically insulated while such a costly and large insulator system as commonly employed by the prior art is no longer necessary. Consequently, the present invention has achieved a method which enables a significant reduction of the insulator system and further a cost reduction in the entire electrostatic spay coating installation.

Other features and advantages of the present invention will be fully understood from more detailed description of preferred embodiments with reference to the accompanying drawings.

BRIEF DESCRIPTION OF THE DRAWINGS

The accompanying drawings illustrate preferred embodiments of an electrostatic spray coating method as embodied in a spray coating installation; in which.

DESCRIPTION OF THE PREFERRED EMBODIMENT

Figure 1:
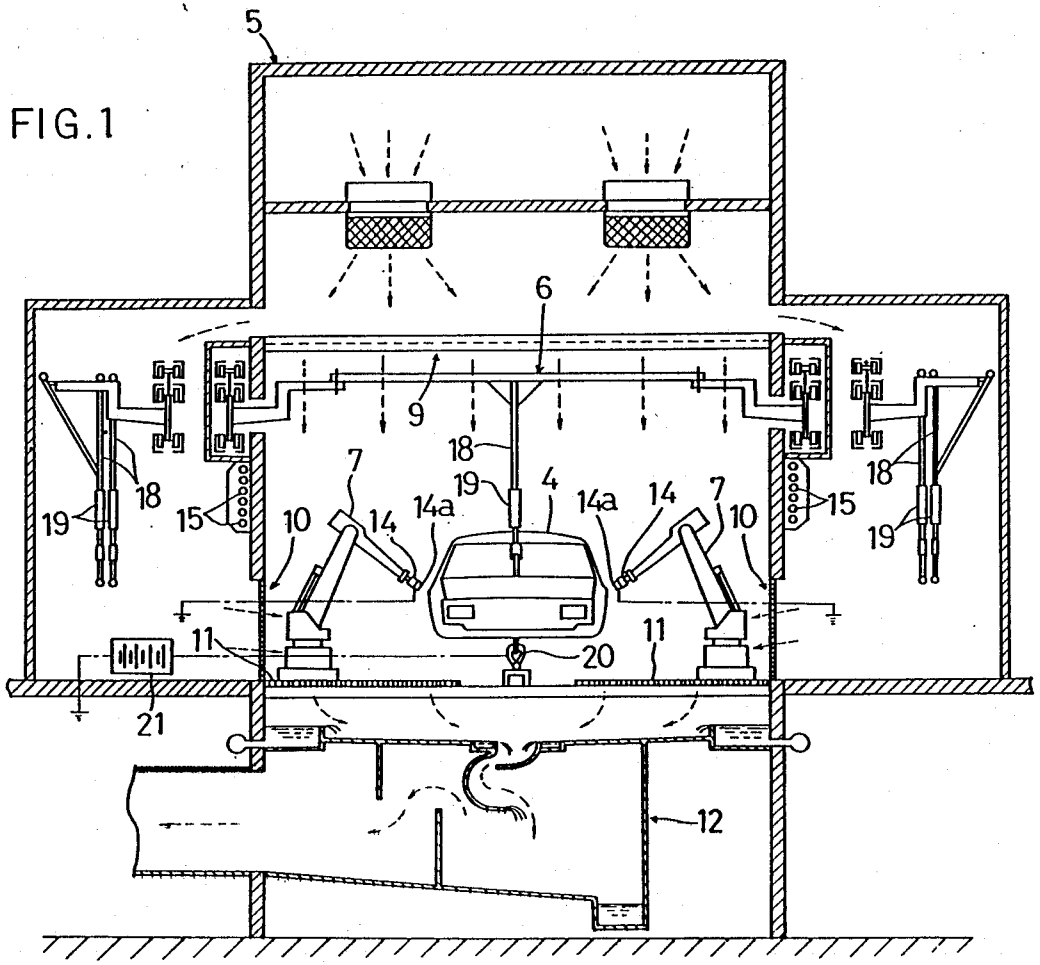
FIG. 1 is an enlarged cross sectional view.
Figure 2:
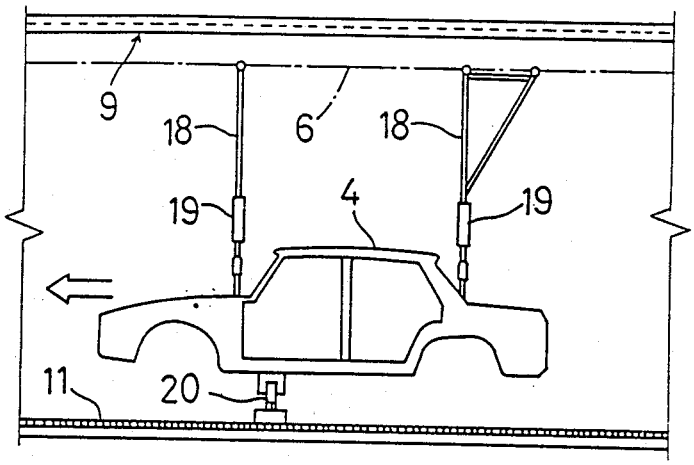
FIG. 2 is an enlarged vertical cross section.
Figure 4:
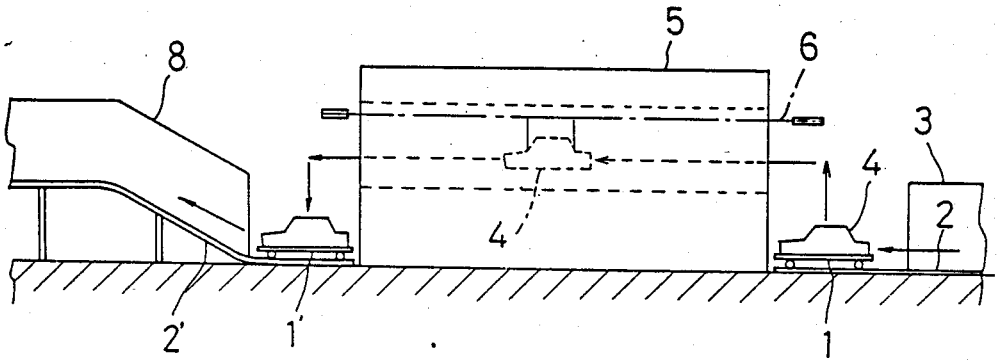
FIG. 4 is a side view.
Figure 3:
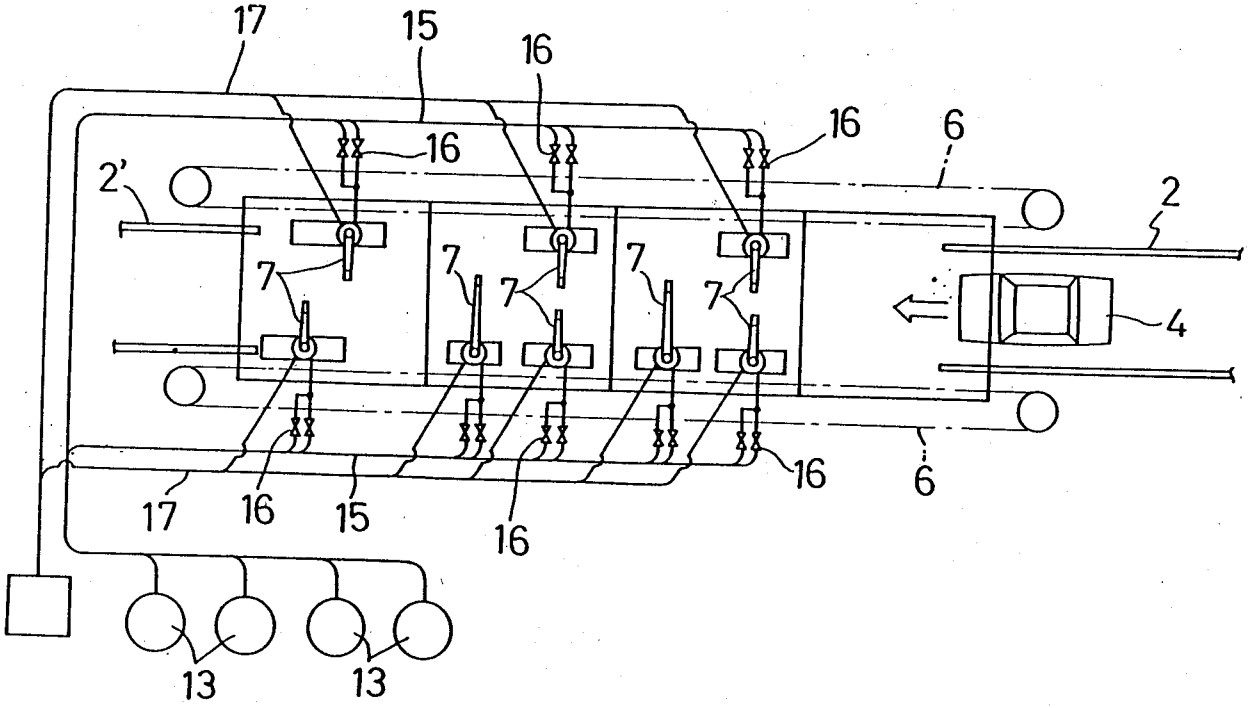
FIG. 3 is a plane view.
Figure 5:
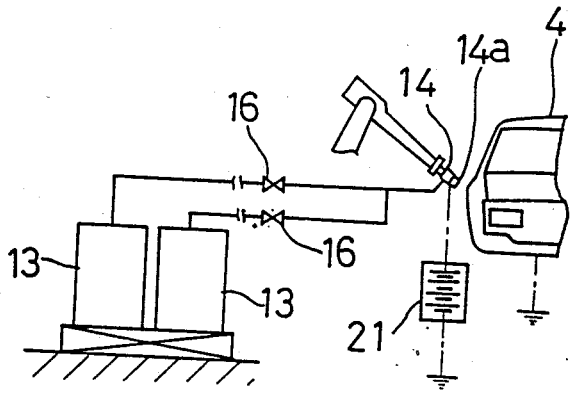
FIG.5 (PRIOR ART)
FIG. 5 is a schematic of a prior-art installation.
Figure 6:
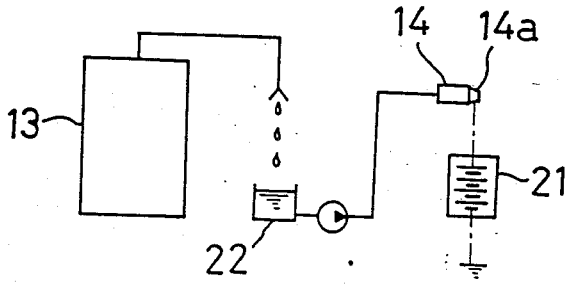
FIG.6 (PRIOR ART)
FIG. 6 is a schematic of a further prior-art installation.

Preferred embodiments of the present invention will be particularly described hereinafter with reference to accompanying drawings of FIGS. 1 through 4.

An object 4 to be painted (the object comprises an automobile vehicle body in these particular embodiments) which has been transported from a preceding stage 3 by means of a floor conveyor 2, is received by a hanger type conveyor 6 at an entrance of a spray booth 5. While this object 4 on the hanger conveyor 6 is being transported inside the booth 5, the object undergoes electrostatic spray coating operations by a plurality of spraying devices 7 installed in the booth 5. At an exit of the spray booth 5, the coated object 4 is mounted on a cart 1' from the hanger conveyor 6 to be transported to a next stage 8.

Referring more particularly to the coating operation carried out inside the spray booth 5, with a ventilating air being fed by blowing with a sloped downward orientation from a side wall air outlet 10, the air inside the booth 5 together with excess paint mist is forcibly exhausted through a grated floor 11 to a waste-paint processing unit 12.

Outside the spray booth 5, there are disposed a plurality of paint tanks 13, each storing therein a paint material of a different color. Each of the spraying devices 7 has its spray gun 14 connected via a paint color changing valve 16 with a paint feed pipe 15 extending from each paint tank 13 and also with an air feed pipe 17 for feeding compressed air for spraying.

The control operations of the respective conveyors 2, 6 and 2' and spraying devices 7 and the switching operations of the paint color changing valves 16 are all effected by an unillustrated central control unit, by an automatic control scheme of which the object 4 undergoes successive electrostatic spray coating operations.

For electrically insulating the object 4 suspended from the hanger conveyor 6, each hanger rod 18 of the conveyor 6 includes an insulator element 19. Further, on the booth floor, there is provided a clamp device 20 which is automatically activated for clamping the object 4 in response to a signal from the central control unit. Upon this clamping action of the clamping device 20, the insulated object 4 is impressed with a positive high voltage generated by a high-voltage generator 21.

On the other hand, adjacent a spraying opening of the spray gun 14 of the spraying device 7, there is attached an electrode 14*a* for forming an electric field between the high-voltage impressed object 4 and the spray gun 14 for electrostatically attracting the sprayed paint to the object 4, with the electrode 14*a* being electrically grounded.

That is to say, while the system side of the spray gun 14 is set as the grounded side, the electrically insulated object 4 is impressed with a high voltage, whereby the sprayed paint particles from the spray gun 14 are charged within the electric field formed between the spray gun 14 and the object 4 and then the charged paint particles are efficiently attracted to the high-voltage impressed object 4 thereby coating the same.

After completion of the predetermined electrostatic spray coating operations, the central control unit transmits a signal to the clamping device 20 to release the same from the object, which is then transported to the outside of the spray booth 5.

Alternative Embodiments (i) In the above embodiment, the electrically insulated object is impressed with a positive high voltage, which may be replaced by a negative high voltage depending on the situation.

(ii) In the above embodiment, the spray gun designed for electrostatic spray coating with an electrically grounded electrode is employed. Instead, with the present invention, it is also possible to employ a spray gun of the ordinary type having no electrode by simply grounding some portion of the paint feed system between the gun and the paint tank.

(iii) The electrostatic spray coating operation may take place both with the object being moved and with the same being kept still. In either case, various improvements are conceivable for the specific means for supporting and maintaining the object under electrically insulated condition.

(iv) Various improvements are possible for the means for impressing the insulated object with a positive or negative voltage. For instance, where the electrostatic spray coating operation is carried out on a moving object, it is possible to provide the clamping device for clamping and voltage-impressing the object with some cable extension which will permit the clamper to follow the moving object. Or, it is also possible to attach to the object a slide-contact element which comes into sliding contact with an electric rail as the object moves thereon.

(v) In place of the spray gun for a spray robot or an automatic spraying device, the present invention may be embodied also with a manual type spray gun operated directly by a worker. The applications of the method of the present invention do not limit the construction of spray booth forming the spraying area or types and constructions of the conveyors for transporting the object.

(vi) Although the method of the present invention is particularly useful where an electrically conductive paint material such as a water-thinnable paint containing water as its main solvent and a metallic paint containing metal powder is employed, the method is also applicable for non-conductive paint material or even powderly paint material.

(vii) Aside from the automobile vehicle body in the previous embodiment, the method is applicable for any other objects such as casings of home electric appliances or steel products for various uses.

What is claimed is:

1. An electrostatic spray coating method where an electrical field is generated in a spraying system between a spray gun and an object to be sprayed, said method comprising the steps of:
   (a) grounding said spraying system;
   (b) electrically insulating said object by suspending said object from a hanger rod with an insulator of a hanger conveyor type installed in a spray booth;
   (c) connecting a clamping device disposed on a floor face of the spray booth to said object; and
   (d) impressing a high voltage on said object by a high-voltage generator via said clamping device which transmits the voltage while clamping said object for electrostatically attracting the paint to the object for coating said object.

2. An electrostatic spray coating method as set forth inclaim 1, wherein said paint material sprayed from said spray gun comprises a water-thinnable material.

3. An electrostatic spray coating method as set forth inclaim 1, wherein said paint material sprayed from said spray gun comprises metallic paint material.

* * * * *